US008432425B2

(12) United States Patent
Yonehara

(10) Patent No.: US 8,432,425 B2
(45) Date of Patent: Apr. 30, 2013

(54) LIGHT-EMITTING UNIT

(75) Inventor: Takao Yonehara, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 207 days.

(21) Appl. No.: 12/922,447

(22) PCT Filed: Apr. 28, 2009

(86) PCT No.: PCT/JP2009/058723

§ 371 (c)(1),
(2), (4) Date: Sep. 13, 2010

(87) PCT Pub. No.: WO2009/133962

PCT Pub. Date: Nov. 5, 2009

(65) Prior Publication Data

US 2011/0013926 A1 Jan. 20, 2011

(30) Foreign Application Priority Data

Apr. 30, 2008 (JP) ..... 2008-118810

(51) Int. Cl.
*B41J 2/45* (2006.01)

(52) U.S. Cl.
USPC ..... 347/238; 108/242

(58) Field of Classification Search ..... 347/130, 347/238, 242
See application file for complete search history.

(56) References Cited

U.S. PATENT DOCUMENTS 5,987,043 A * 11/1999 Brown et al. ..... 372/36
2002/0135665 A1* 9/2002 Gardner ..... 347/238
2005/0094397 A1 5/2005 Yamada et al. ..... 362/253
2005/0247947 A1 11/2005 Owen et al. ..... 257/89
2005/0253252 A1 11/2005 Owen et al. ..... 257/714
2008/0080897 A1* 4/2008 Gomi ..... 399/221
2009/0115833 A1* 5/2009 Soulliaert et al. ..... 347/238

FOREIGN PATENT DOCUMENTS

| | | |
|---|---|---|
| EP | 1475846 | 11/2004 |
| JP | 61-209176 | 9/1986 |
| JP | 62-249778 | 10/1987 |
| JP | 63-192066 | 8/1988 |

OTHER PUBLICATIONS

International Preliminary Report on Patentability dated Nov. 11, 2010, from corresponding PCT Application No. PCT/JP2009/058723.

* cited by examiner

*Primary Examiner* — Julian Huffman
*Assistant Examiner* — Sharon A Polk
(74) *Attorney, Agent, or Firm* — Fitzpatrick, Cella, Harper & Scinto

(57) ABSTRACT

A light-emitting unit having an arrayed light source comprises a substrate; an arrayed light source group containing the arrayed light source arranged in a first direction; a lens array for focusing the light emitted from light emitting elements constituting the arrayed light source; and a lens support having a cavity formed between arrayed light source group and the lens array; the lens support having a first hole for introducing a fluid into the cavity, and a second hole for discharging the introduced fluid in a second direction crossing the first direction.

13 Claims, 6 Drawing Sheets

LIGHT-EMITTING UNIT

TECHNICAL FIELD

The present invention relates to a light-emitting unit. In particular, the present invention relates to a light-emitting unit employed as a light source of an LED printer head.

BACKGROUND ART

Some LED printer heads employ an optical system containing an SLA (Selfoc Lens Array: registered trademark of Nippon Sheet Glass Co. Ltd.) which contains an array of gradient-index lenses for forming one continuous image in its entirety.

The LED constituting the LED printer head generates heat in light emission. To offset the adverse effect of the heat generated by the LED, Japanese Patent Application Laid-Open No. S62-249778 employs a finned member attached to the base plate carrying the LED array.

The above-mentioned SLA itself is constituted of a glass material. The inventors of the present invention considered use of a plastic material instead of the glass material for the lens array typified by the SLA for further decrease of the weight and reduction of the production cost.

The inventors of the present invention noticed that the lens array constituted of a plastic instead of the glass can be affected by the heat generated by an adjacent LED light-emitting element. The SLA (trade name of Nippon Sheet Glass Co. Ltd.) is a kind of a lens array, in which the rod lenses are formed from a transparent fiber useful as an optical fiber. In the transparent fibrous lens, the refractive index is changed from the surface toward the inside concentrally to obtain the lens effect. To decrease the interference between the adjacent rod lenses to prevent occurrence of stray light, the side wall of the rod is shielded from light by a resin or a like material. Further, a technique is disclosed of laminating a microlens array on a glass plate or a plastic plate by lithography or a like process to obtain an erect equal-sized lens effect. This method is advantageous in that deviation of optical axes among the rods is practically decreased in bundling of the rod lenses in an array. The present invention is applicable in the above-mentioned two types of lens arrays.

DISCLOSURE OF INVENTION

The present invention intends to provide a light-emitting unit having a novel constitution which is capable of lessening the adverse effect of the heat generated by the light source like an LED on the lens array like a rod lens array.

The present invention is directed to a light-emitting unit having an arrayed light source, comprising:

a substrate;

an arrayed light source group containing the arrayed light source arranged in a first direction on the substrate;

a lens array for focusing the light emitted from light emitting elements constituting the arrayed light source; and a lens support having a cavity formed between arrayed light source group and the lens array;

the lens support having a first hole for introducing a fluid into the cavity, and a second hole for discharging the introduced fluid in a second direction crossing the first direction.

The lens support can have a plurality of the second holes arranged in the first direction.

In the light-emitting unit, a pressure-rising unit can be provided in the first hole for rising the pressure of the fluid in the cavity.

The light-emitting element can be an LED.

The light-emitting element can be a light element having a semiconductor multi-layered mirror.

The light-emitting elements can be placed on a silicon member.

The first hole and the second hole can be closed by a member for closing the first hole and the second hole.

The fluid can be a gas.

In the light-emitting unit, third holes can be formed through the side face of the lens support in opposition to the second holes.

The lens array can be a rod lens array.

The lens array can be formed from a plastic material, the substrate is formed from silicon.

The present invention is directed to an image-forming apparatus comprising:

the light-emitting unit, and a photosensitive drum for forming a latent image on irradiation with light from the light-emitting unit.

The present invention is directed to a method for cooling a light emitting unit, comprising:

flowing a fluid through a cavity surrounded by arrayed light sources, lens array and a lens support for fixing the relative positions of the arrayed light sources and the lens array in a first direction in which the light sources are arranged, and discharging the fluid in plural flows in a second direction crossing the first direction.

The present invention enables decrease of the adverse effect of the heat generated by the light emitting element by diffusing the heat by a fluid.

Other features and advantages of the present invention will be apparent from the following description taken in conjunction with the accompanying drawings, in which like reference characters designate the same or similar parts throughout the figures thereof.

BEST MODE FOR CARRYING OUT THE INVENTION

Preferred embodiments of the present invention will now be described in detail in accordance with the accompanying drawings.

Firstly the basic constitution of the light-emitting unit of the present invention is described with reference to FIGS. 1A, 1B, 1C, 1D and 1E.

Figure 1A:
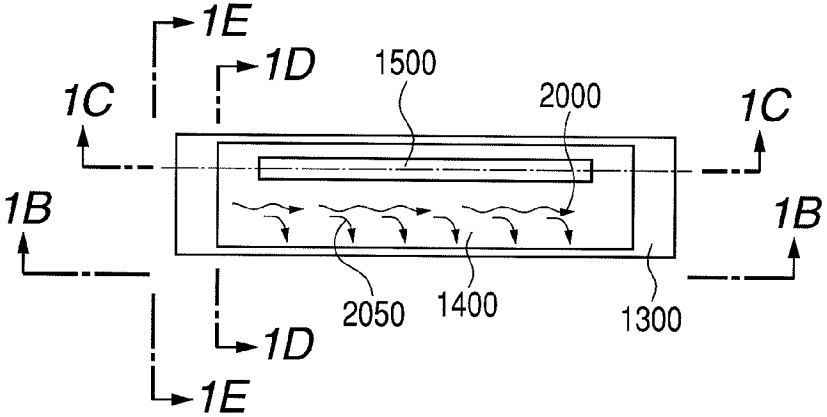
FIGS. 1A, 1B, 1C, 1D and 1E are schematic drawings for describing the present invention.
Figure 1B:
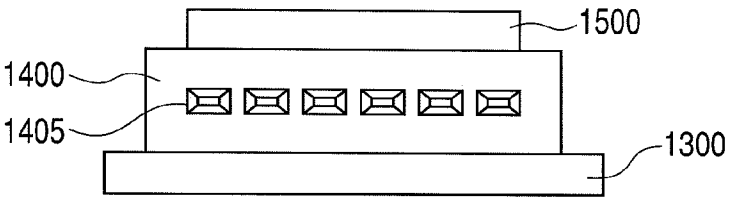
Figure 1C:
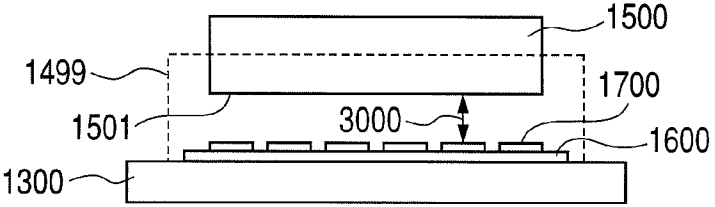
Figure 1E:
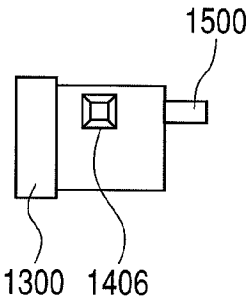
Figure 1D:
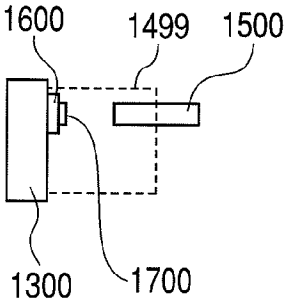

In FIGS. 1A, 1B, 1C, 1D and 1E, each drawing and reference numeral illustrates as follows: FIG. 1A, a top view of the light-emitting unit; FIG. 1B, a side view of the light-emitting unit; FIG. 1C, a sectional view along line 1C-1C; 1499, a lens support (indicated by a dotted line); FIG. 1E, another side view of the light-emitting unit; and FIG. 1D, a sectional view along line 1D-1D (the lens support being indicated by a dotted line). The drawings illustrate schematically the light-emitting unit. Incidentally, in FIGS. 1C and 1D, lens support 1400 is indicated by dotted line 1499 for understanding of the inside structure.

In FIGS. 1A, 1B, 1C, 1D and 1E, the numeral 1300 denotes a base plate, 1400 denotes a lens support, and the numeral 1500 denotes a lens array (e.g., a rod lens array). The lens array focuses a light beam emitted from the light-emitting element. In the side view FIG. 1E, first hole 1406 is shown. In the sectional view FIG. 1C, the numeral 1600 denotes a substrate like a print substrate placed on the base plate. The numeral 1700 denotes an arrayed light source provided on substrate 1600 (the arrayed light source containing plural light-emitting elements (plural light-emitting spots)). The sectional view FIG. 1C shows arrangement of arrayed light sources 1700 on substrate 1600.

As shown in the side view FIG. 1B, lens support 1400 has second holes 1405. Further, third holes may be provided on the side opposite to the second holes of the lens support 1400, if necessary. Into the cavity surrounded by lens support 1400, lens array 1500, and the arrayed light sources (arrangement of arrayed light source 1700), a fluid (e.g., a gas like air and nitrogen, and a cooled gas) can be introduced through first hole 1406. The fluid introduced into the cavity is discharged in the direction of arrow mark 2050, and in the direction of arrow mark 3000 if the third holes are provided, for effective heat release as shown in FIGS. 3A, 3B, 3C, 3D and 3E.

In the cavity, the introduced fluid flows in first direction 2000 denoted by arrow mark 2000, and is discharged through second holes 1405 in second direction 2050 (and/or through third holes, if provided, in third direction 3000) crossing the first direction.

First direction 2000 and second direction 2050 should cross each other. For example, with the fluid flowing in first direction 2000, openings may be formed to allow the fluid to flow in the direction perpendicular to the plane of the drawing differently from the direction indicated in the drawing. Second holes 1405 are preferably provided at least to correspond to respective allayed light sources 1700.

Naturally, in place of a plurality of second holes 1405, one large opening may be provided. However, a plurality of finer holes (e.g., tens of μm to several mm in diameter) are preferred to one large opening for keeping the atmospheric pressure in the cavity higher than the outside to prevent penetration of particles like toner particles into the cavity.

In the above description, first hole 1406 is provided on one side of lens support 1400. However, the first hole may be provided on both sides of the lens support. The position of first hole 1406 is not limited specially, insofar as the fluid can be allowed to flow in the aforementioned first direction 2000.

With such a constitution, the heat generated by plural light-emitting elements (not shown in the drawing) of the arrayed light sources 1700 can be removed by the fluid flow. Thus, the heating of the light-emitting element end side (1501) of the rod lens array by the light emitting elements can be weakened.

For example, when a light-emitting diode (LED) is used, heat in an amount corresponding to several mW can be removed per element depending on the efficiency of light takeout by the element.

The temperature of the element can rise by several to several tens of degrees C. In continuous light emission, the heat energy (Joule heat) corresponding to a hundred of degrees C. can be estimated to be radiated.

With a lens array made from a glass material (e.g., quartz glass), the temperature change is estimated as below. The lens surface confronting the LED element can be heated up to several to tens of degrees C., in some cases to hundreds of degrees C. approximate to the temperature of the element surface, by heat radiation from the element and heat conduction through the intervening air and the supporting member, and convection of the air layer. This temperature rise will cause change in the refractive index of the lens, thermal expansion, and softening or melting of the resin (about 60° C. when the lens is made from a resin) to result in deviation of the lens properties or deviation of the lens axis from the normal level. This will give great adverse effect on the positional precision in latent image formation on the photosensitive drum surface. In an extreme case, the temperature rise of the element and the lens can cause deviation of the position of the exposure spot by hundreds of microns.

The plastic material for the rod lens array includes thermoplastic resins such as polymethyl methacrylate resins, polycarbonate resins, and cyclic olefin polymers; and thermosetting resins such as diethylene glycol diallyl carbonate resins, and siloxanyl methacrylate resins. When such a material is used, the temperature can rise by several to tens of degrees C. depending on the efficiency of element property take-out. This temperature rise causes changes in the lens optical axis, refractive index, and rigidity of the lens, resulting in great adverse effect on the processes of latent image formation, and transfer and printing of the image on a recording medium. Thus the effect of the present invention is remarkable when a plastic lens array is used.

The crossing angle between the first direction and the second direction is preferably close to a right angle, but is not limited thereto.

For effective cooling of end 1501 of the rod lens array, second holes 1405 are preferably provided between the top ends of arrayed light sources 1700 and the end of rod lens array 1501 (as shown by arrow mark 3000 in FIGS. 1A, 1B, 1C, 1D and 1E).

The rod lens array is constituted of parallel arrangement of rod-shaped lenses and forms one continuous image in its entirety by superposing the erect equal-sized images of the respective rod lenses. The rod lens array is described as an example of the lens array. Naturally, the lens array includes a focusing optical fiber lens array employing a gradient-index lens, SLA (trade name), and a roof mirror lens array constituted of a roof-shaped mirror and lenses. The lens array may be constituted of a plastic material as mentioned later.

(First Hole, Second Holes, and Third Holes)

Lens support 1400 has a plurality of second holes 1405 arranged in first direction 2000 as illustrated in FIG. 1B.

A pressure-raising unit (e.g., a fan, or preferably a pump) may be connected to first hole 1406 to raise the pressure of the fluid in the cavity.

The aforementioned light-emitting unit is useful as a printer head of an image-forming apparatus such as a printer and a copying machine. In the image-forming apparatus, the toner or a like powder scattered can adhere to the periphery of the photosensitive drum. The toner can adhere to the surface of the lens or a light-emitting face which is bared in the cavity in the light-emitting unit. Such adhering powdery matter soils or shadows the lens face or the light-emitting face to lower the light intensity, or further to lower the print quality. In the present invention, the heat can be released and the shadowing of the light-emitting elements by the powdery matter can be prevented simultaneously by introducing the fluid through a filter at the first hole for powder removal into the cavity, and discharging the fluid from the second holes.

For pressure-feeding of a gas through the first hole, the pump may be connected through a soft flexible tube to the first hole for gas introduction. This is effective for preventing the soiling of the surfaces of the elements and lenses. Further, another soft flexible tube may be connected to form a closed loop constituted of the pump, the first hole, the cavity in the light-emitting unit, and the second holes (and third holes as necessary) to prevent intrusion of dust like the toner.

For constituting an image-forming apparatus for forming an electrostatic image on a photosensitive drum, the lens array end face of the light-emitting unit of the present invention is counterposed to the outside face of the photosensitive drum. The light-emitting unit may be placed inside of the cylindrical photosensitive drum. In this constitution, the light-emitting unit of the present invention is effective for promoting the release of the heat generated by the light-emitting element.

In distribution of a separate printer head not assembled into an image-forming apparatus in the market, intrusion of dust from the first hole, the second holes, and other openings into the head is prevented as necessary. For prevention of the dust intrusion, the holes and openings are preferably sealed by a sealing member (e.g., an adhesive tape, a sealing material, and a member having projections fitting to the fine holes).

The first hole is preferably made larger than the second hole. The first hole has a diameter of several millimeters to tens of millimeters, preferably from 5 mm to 10 mm. The second and the third holes have a diameter ranging from 0.3 mm to 10 mm, preferably from 1 mm to 5 mm in consideration of the gap between the Selfoc Lens and the element surface being decided by the conjugate length of the lens.

(Arrayed Light Source 1700 (Arrayed Chip))

A plurality of arrayed light source chips forms an arrayed light source group. The arrayed light source chip 1700 is constituted of plural light-emitting elements. The light-emitting element includes not only usual LEDs but also special LED which has a metal mirror or a semiconductor-lamination mirror on the light-emitting side (rod lens array side) and the opposite side (substrate side), and a so-called laser.

The LED is known to function as a heat source. This is because the LED layer is formed on a GaAs substrate having a thermal conductivity much lower than silicon. Persons skilled in the art consider that the heat generation by the LED can be made negligible by placing the light-emitting element layer on a silicon substrate (e.g., having a driving circuit) owing to the higher thermal conductivity of silicon (three times that of the GaAs substrate). Thus the heat generation by the LED causes no problem with the rod lens array made of a glass material. However, with the rod lens array made of a plastic material, the heat generation by the LED causes a problem even if the LED layer is placed on a silicon substrate. The present invention is very effective in weakening the adverse effect of the heat generation.

The light-emitting element will be described later with reference to an example.

(Substrate 1600)

Substrate 1600 is a so-called print substrate. The preferred substrate is a highly heat-conductive print substrate (including highly heat-conductive ceramic substrates, glass-epoxy type substrates, and metal-based substrates).

(Rod Lens Array 1500)

An example of rod lens array 1500 is constituted of a glass material having a refractive-index distribution formed by diffusing an impurity into a quartz fiber by ion-exchange. Another example of the plastic rod lens array is formed from a thermoplastic resin or a thermosetting resin by spinning to form refractive index distribution. Still another example is a plate-shaped microlens array which is constituted of an integration of rod-shaped lens and is capable of giving an erect equal-sized optical effect.

(Lens Support 1400)

The lens support may be formed from a highly heat-conductive resin (e.g., polycarbonate) or a metal (e.g., aluminum).

To the first hole, a fan or a pressure pump may be connected to introduce a gas like air into the cavity. In particular, first hole 1406 and second and third holes 1405 may be connected by a tube to recycle the gas discharged from the second and third holes to the first hole, whereby the intrusion of dust particles can be prevented effectively.

In a preferred constitution, a fluid like a gas is introduced through first hole 1406 at a positive pressure, and the fluid is discharged from second holes 1405 by a pressure difference.

Lens support 1400 can be fixed to lens array 1500 by a high thermal-conductivity adhesive layer (an epoxy resin filled with a metal or ceramic).

(Base Plate)

Base plate 1300 is preferably made of a metal material like aluminum. Further, for heat release or cooling, a fin may be attached to the bottom or lateral side of the base plate.

In the present invention as described above, a fluid is allowed to flow in a first direction in the cavity, and the fluid is allowed to flow in a second direction crossing the first direction through openings provided corresponding to the respective arrayed light sources. The present invention is not limited to the unit mentioned above.

The present invention relates also to a method for cooling the light-emitting unit.

In the method of the present invention, the arrayed light sources placed on the substrate and the rod lens arrays are fixed in a predetermined relative position. In the cavity surrounded by a lens support, the light sources, and the lens arrays, a fluid is allowed to flow in a first direction of the arrangement of the arrayed light sources. The fluid flowing in the first direction is discharged in a second direction crossing the first direction in plural flows. In addition to the second holes for discharging the fluid, another hole may be provided on the face opposite to the first hole in the first direction, and the fluid is allowed to flow through the cavity. The gas near the face of the light-emitting elements is discharged effectively by allowing the fluid like a gas to flow in the second direction crossing the first direction. In particular, the second holes are placed preferably at positions confronting the respective arrayed light sources. Another first hole may be provided additionally at the side wall opposite to the first hole of the lens support to introduce the fluid also through the additional first hole. With such a constitution, the gas is introduced from the both sides of the cavity constituted of the lens support and other members in the direction of arrangement of the arrayed light sources, and the gas is discharged in the direction crossing the gas introduction direction.

If necessary, the fluid may be discharged in both the second direction and the third direction.

(Process for Producing Light-Emitting Element)

A process for producing a light-emitting element of this embodiment by a bonding method is described with reference to FIGS. 4A, 4B, 5, 6 and 7.

Firstly, a first substrate for LED formation and a second substrate for transferring a light-emitting layer are described with reference to FIGS. 4A and 4B.

Figure 4A:
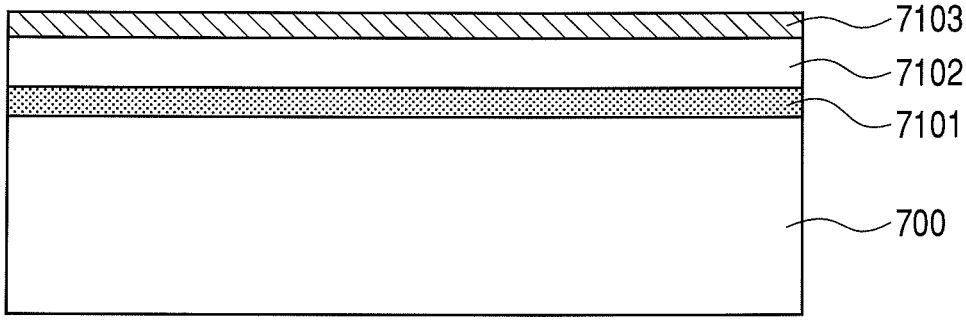
FIGS. 4A and 4B are schematic drawings for describing a process of producing a light-emitting element for the present invention.

As illustrated in FIG. 4A, on first substrate 700, light-emitting layer 7102 containing an active layer and a DBR layer 7103 are formed with interposition of separation layer

7101. This DBR layer may be omitted, if not necessary, or may be substituted by a metal mirror.

First substrate 700 is employed for forming an LED (light-emitting diode), and thereon a compound semiconductor film can be grown. When an III-V compound system based on GaAs is grown thereon, the first substrate may be a GaAs substrate or Ge substrate having approximate lattice constant. The GaAs substrate may contain a homologous element such as Al and P. The substrate may contain an impurity for formation of P-type or N-type for the device constitution.

On this first substrate 700, separation layer 7101, light-emitting layer 7102, and DBR layer 7103 are epitaxially grown successively by an MOCVD method, an MBE method, or a like method. Separation layer 7101 can be selectively etched without etching light-emitting layer 7102 composed, for example, of AlAs, $Al_xGa_{1-x}As$ ($1<x<0.7$). The separation layer of such a composition is etched selectively by a hydrofluoric acid solution.

Light-emitting layer 7102 is constituted of a compound semiconductor layer functioning as a light-emitting element, composed, for example, of GaAs, AlGaAs, InGaAs, GaP, InGaP, AlInGaP, and the like, and has pn junction in the layer. Light-emitting layer 7102 is specifically constituted, for example, of an active layer held between two clad layers.

DBR layer 7103 can be grown epitaxially on first substrate 700, and is constituted of a superposition of several pairs of layers different in the refractive index to the intended LED wavelength.

The pair is constituted of a higher refractive index layer and a lower refractive index layer. The lamination of a plurality of the pairs is called a Bragg reflection layer, or a DBR mirror (DBR layer).

This Bragg reflection layer is formed from two kinds of films different in the refractive index having respectively an optical film thickness n×d of ¼ wavelength (film thicknesses: d1, and d2) and laminating m pairs of the films (m: a natural number of 2 or more) to obtain a reflectivity corresponding to the number m of the film pairs. The larger the difference of the refractive index between the paired films for constituting the Bragg reflection layer, the higher is the reflectivity with less number of the film pairs. In the present invention, the conditions for construction of the DBR is preferably optimized to obtain reflectivity at a specified wavelength of light of not less than 70%, preferably not less than 80%, more preferably not less than 90%.

For example, a DBR layer is formed by laminating alternately AlGaAs films different in Al content. In order to prevent a damage of the DBR layer in selective removal by etching of the aforementioned separation layer, the Al content x in the film of a composition represented by $Al_xGa_{1-x}As$ is preferably not more than 0.8, more preferably not more than 0.7, still more preferably not more than 0.6, still more preferably not more than 0.4. The lower limit of x is zero.

For constituting the DBR layer, the material of the film of the lower refractive index is selected from $Al_xGa_{1-x}As$ ($0<x<0.8$), AlInGaP type materials, and AlGaP type materials. The material of the separation layer may be selected from AlAs and $Al_xGa_{1-x}As$ ($0.7<x<1.0$). The combination of the layers should be selected so as not to cause a damage of the lower-refractive-index layer in the selective etching removal of the separation layer. Incidentally, when the separation layer is an AlAs layer, and the lower-refractive-index layer is made of an AlInGaP type material or an AlGaP type material, the separation layer can be removed selectively depending less on the Al content.

Three examples of the combination of "(higher-refractive-index film)/(lower-refractive-index film)" which are resistant against hydrofluoric acid are shown below;

$Al_{0.6}Ga_{0.4}As/Al_{0.2}Ga_{0.8}As$, $AlInGaP/Al_{0.2}Ga_{0.8}As$, $AlGaP/Al_{0.2}Ga_{0.8}As$.

The number of the pairs required for preparation of a laser is 30, 40, or more layers to obtain a reflectivity of 99.9% or higher. However, for preparation of an LED which requires the reflectivity of not lower than 90%, several to ten layers are enough.

Figure 4B:
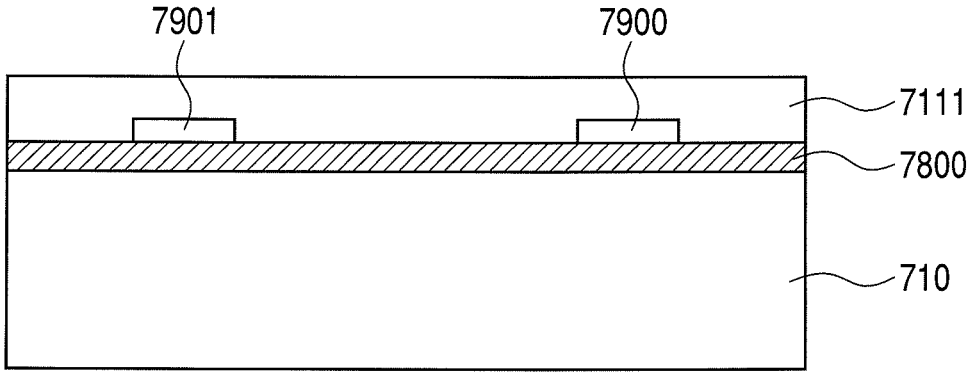

In FIG. 4B, second substrate 710 onto which light-emitting layer 7102 is transferred is a silicon substrate having semiconductor driving circuit 7800.

On the face of this substrate 710, electrode pads 7900, 7901 are formed for electric connection with the LED. Thereon, organic insulation film 7111 is formed to isolate electrically the driving circuit from the LED to be transferred.

In the case where a simple silicon substrate without a driving circuit is employed, driving circuit 7800 and electrode pads 7900, 7901 need not be considered.

Organic insulation film 7111 is preferably a sticky flat film to serve also as an adhesive for bonding first substrate 700 with second substrate 710.

This organic film is exemplified by a film spin-coated with an organic material like a polyimide, but any material other than the polyimide may be used insofar as the material satisfies the conditions such as insulating property, adhesiveness, and thermoplasticity. Otherwise an inorganic insulation film (such as SOG) is also applicable in the present invention.

The process for bonding first substrate 700 to second substrate 710 is described with reference to FIG. 5.

DBR layer 7103 and light-emitting layer 7102 formed on the face of first substrate 700 are patterned by grooving to form island-like regions. Specifically, the DBR layer and the light-emitting layer are etched to bare portions of separation layer 7104. The etching is preferably stopped when the separation layer has been just bared. However, even if etching of the separation layer proceeds excessively through the separation layer to reach the substrate, the later process can be conducted. When the etching is stopped before penetration of the separation layer, the first substrate can be reused after the separation. Incidentally, a layer serving as an etch-stopping layer may be provided between first substrate 700 and separation layer 7101.

Figure 5:
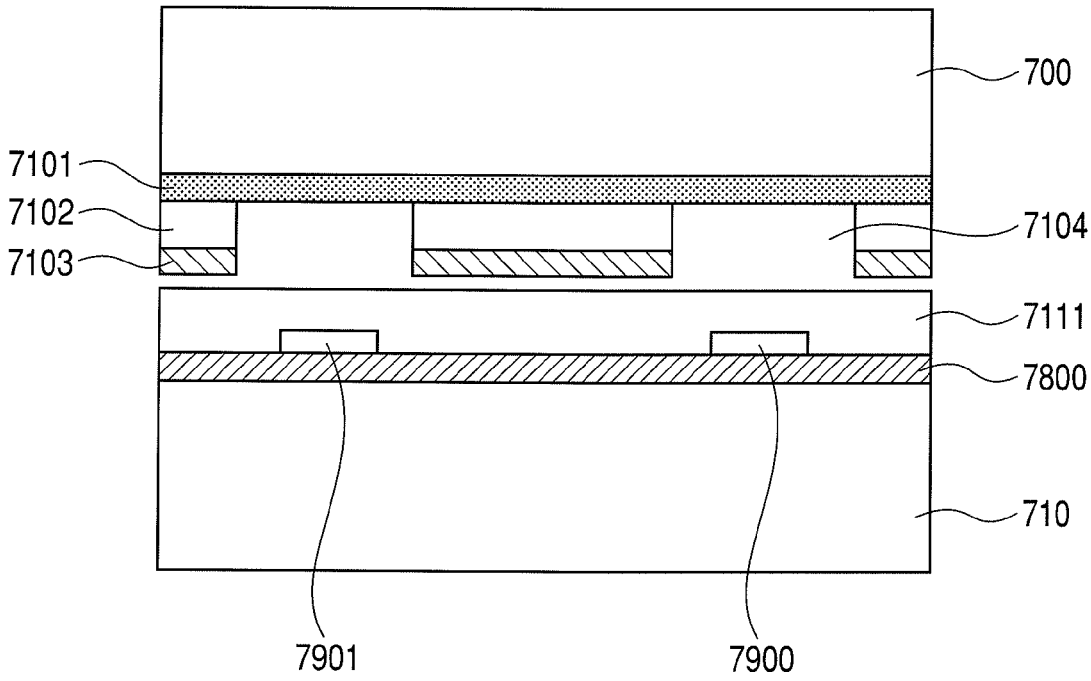
FIG. 5 is a schematic drawing for describing a process of producing a light-emitting element for the present invention.

As illustrate in FIG. 5, the face of the first substrate having island-patterned DBR layer 7103 and light-emitting layer 7102 is bonded to the face of organic insulation film 7111. The bonding is preferably conducted after the LED and the driving circuit are aligned for electrical connection. In the bonding process, the contacted both faces are heated for increasing the bonding strength. The heating temperature depends on the material of the insulation film: roughly several tens of degrees C. to about 300° C. As the result of the bonding, an interspace is formed in an island shape by the groove in the bonded layer.

Next, the transfer process by etching of separation layer 7101 is described with reference to FIG. 6.

The above-mentioned interspace (groove) formed by the bonding serves as a flow path for introducing an etching solution. A hydrofluoric acid solution is introduced as the etching solution into this flow path. The etching solution can be introduced simply by immersing the entire substrate in the etching solution. For promoting the penetration of the solution, preferably the solution is jetted toward the bonded interface, or an ultrasonic wave is applied to the immersed substrate.

Figure 6:
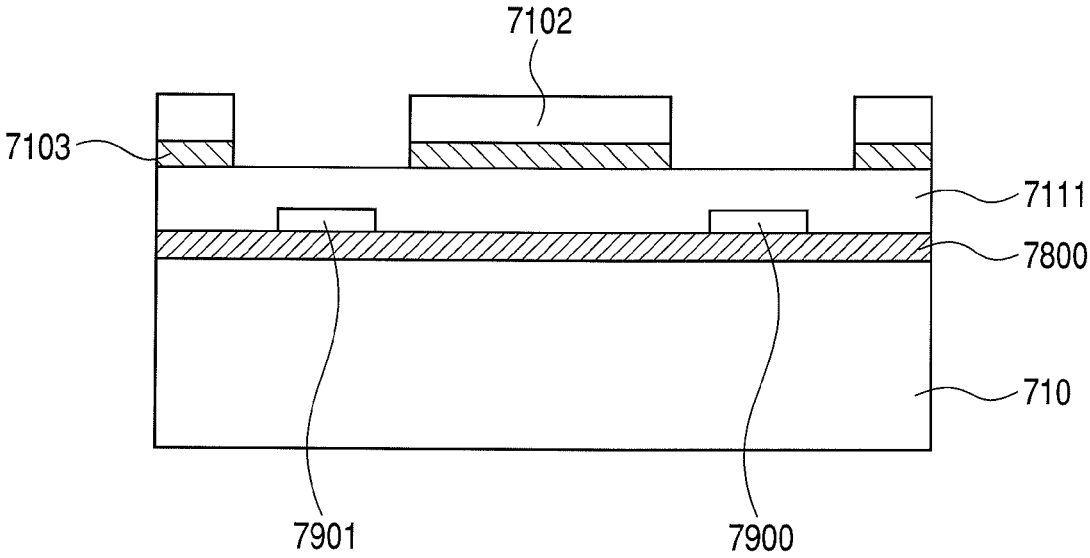
FIG. 6 is a schematic drawing for describing a process of producing a light-emitting element for the present invention.

The hydrofluoric acid introduced into the flow path etches selectively the separation layer bared to the flow path to complete the transfer of DBR layer 7103 and light-emitting layer 7102 onto second substrate 710 as illustrated in FIG. 6.

The LED array of this embodiment is produced as described above.

Next, a method of electrical connection of driving circuit 7800 on second substrate 710 with the light-emitting layer is described.

Figure 7:
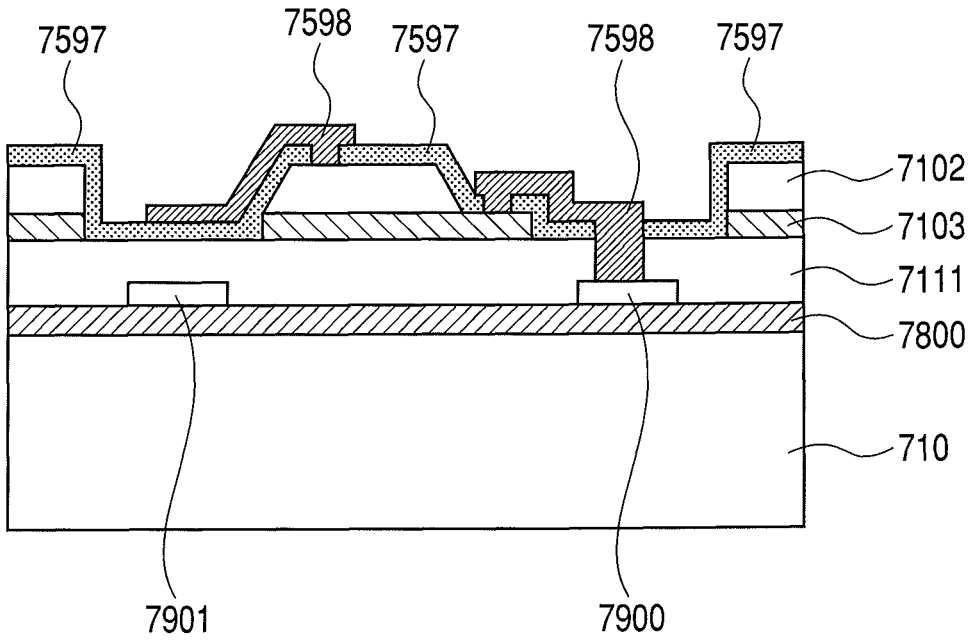
FIG. 7 is a schematic drawing for describing a process of producing a light-emitting element for the present invention.

FIG. 7 is a drawing for describing the process of electrical connection of the LED with driving circuit 7900.

Transferred light-emitting layer 7102 is constituted of a P layer and an N layer (P and N denoting the conduction type). A part of the light-emitting layer is etched to bare the layer of the induction type opposite to that of the surface, and the entire is covered with an insulation film. Then a contact hole is formed for electrode contact. The LED and the electrode pad of the driving circuit are connected by forming a via hole through the organic insulation film, depositing an electrode material, and patterning of the material.

In this process, plural LEDs are patterned to form an LED array to be controlled by the driving circuit.

In FIG. 7, the light-emitting layer and the driving circuit are connected together electrically through DBR layer 7103. Naturally, the layer having the conduction type opposite to that on the surface side of the light-emitting layer may be bared and be connected electrically directly with the driving circuit.

In FIGS. 4A and 4B, on first substrate 700, with interposition of the separation layer, the light-emitting layer and the DBR layer are formed in the named order. However, the DBR layer and the light-emitting layer may be formed in this order. In this case, a temporary substrate is bonded thereto tentatively and then the layers are bonded to the second substrate. Without the temporary substrate employed, the separation process is conducted after the bonding process (bonding of the DBR layer and the second substrate). With the temporary substrate employed, after the patterning, the light-emitting layer is bonded to the temporary bonding substrate, then the separation process is conducted, and thereafter the bonding (bonding of the DBR layer and the second substrate) is conducted.

In FIG. 4A, between first substrate 700 and separation layer 7101, or between the separation layer and light-emitting layer 7102, another layer may be interposed.

Through the above-described patterning process, the light-emitting layer separated into elements in a shape of islands contains a plurality of light emitting portion. After the above separation process, the light-emitting portions may be separated into elements corresponding to isolated light-emitting points.

As the substrate for the light-emitting element, a compound semiconductor substrate is useful.

As described above, the DBR layer on the surface is bonded with interposition of the insulation layer to a silicon substrate which may have a driving circuit. Then the separation layer is etched off to transfer the light-emitting layer and the DBR layer onto the silicon substrate which may have the driving circuit.

Thereby the heat release of the unit is improved in comparison with the light-emitting unit produced by the conventional DBR process in which a compound semiconductor substrate is directly used. Further, by the process, the wire bonding between the compound semiconductor substrate and the driving circuit for the LED array can be simplified by the transfer of the light-emitting layer and the DBR layer onto a silicon substrate having a driving circuit formed thereon.

The process for production of the light-emitting element according to the present invention is described above. The present invention is applicable not only to the above light emitting element but also to other light-emitting elements produced by other method.

EXAMPLE

Example: LED Head

Figure 2:
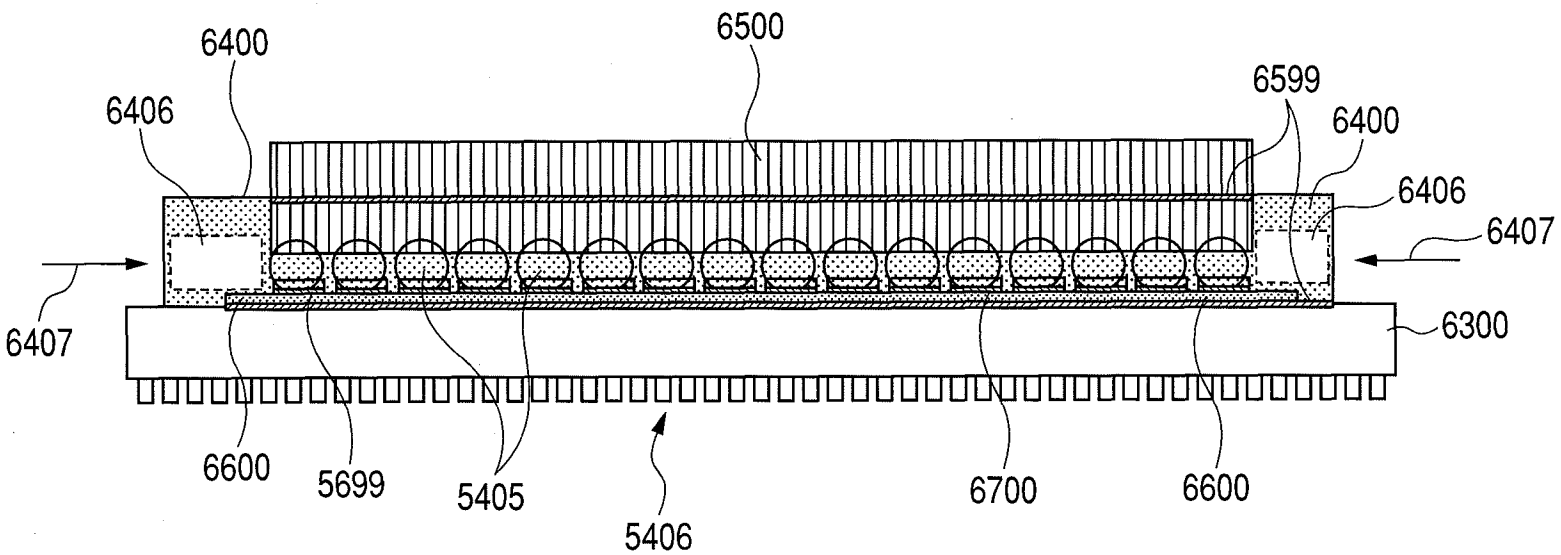
FIG. 2 is a schematic drawing for describing the present invention.
Figure 3A:
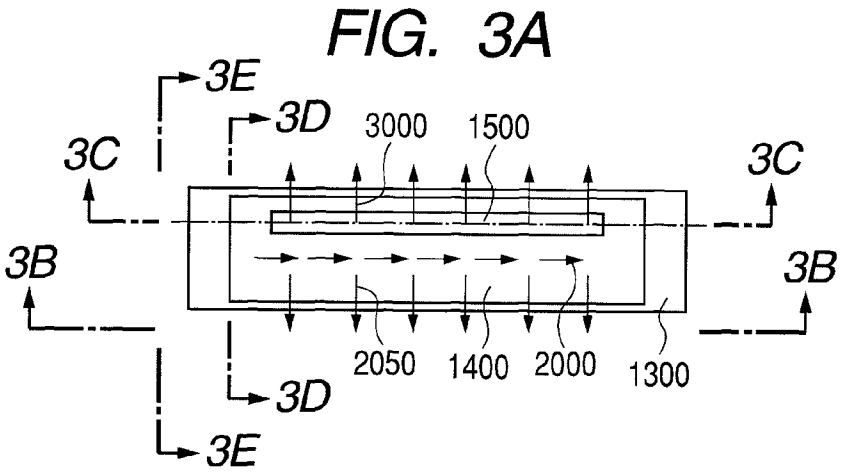
FIGS. 3A, 3B, 3C, 3D and 3E are schematic drawings for describing the present invention.
Figure 3B:
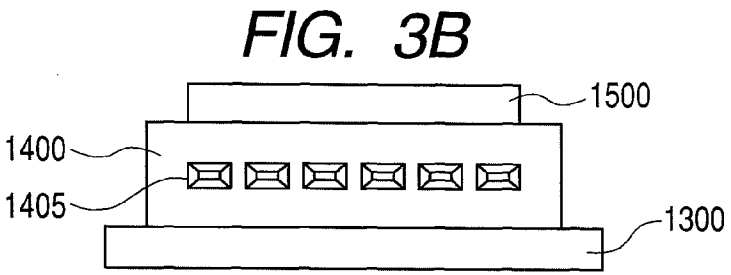
Figure 3C:
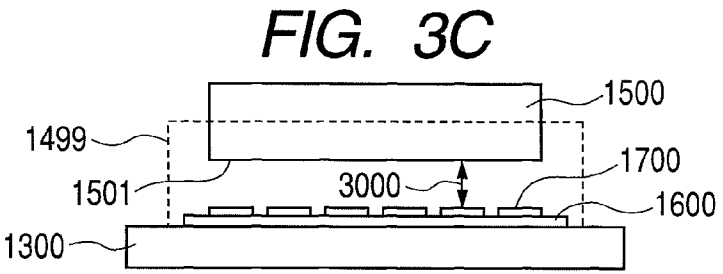
Figure 3E:
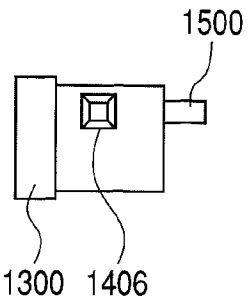
Figure 3D:
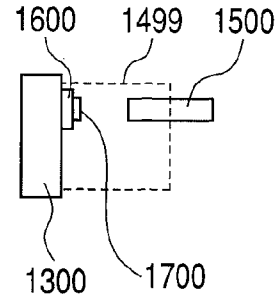

An LED head employing the light-emitting unit is described with reference to FIG. 2.

Fin structure 5406 for cooling is provided on base plate 6300. Highly heat-conductive adhesive layer 6599 is placed between base plate 6300 and high heat-conductive print substrate 6600. LED array chips (arrayed light source) 6700 of the LED light-emitting layer are provided on the Si substrate. Onto lens support 6400 (constituted of a highly heat conducting resin or a metal), second holes 5405 and counterposed third holes are formed for discharging the gas for heat release, and first holes 6406 are formed for blowing a gas. In this example, two first holes 6406 are formed in the lens support 6400 (constituted of a highly heat-conductive resin or a metal). Into the cavity surrounded by arrayed light source 6700, rod lens array 6500, and the lens support, air is introduced through the counterposed first holes in the first direction (arrangement direction of the arrayed light source) as indicated by arrow marks 6407. This air introduction makes positive the pressure in the cavity, and the air is discharged through the second and third holes (5405). The discharge of the air through the third holes in a third direction is shown by arrow marks 3000 in FIGS. 3A, 3B, 3C, 3D and 3E. Incidentally, in FIGS. 3A, 3B, 3C, 3D and 3E, the same reference symbols are used as in FIGS. 1A, 1B, 1C, 1D and 1E to indicate the same members.

In this example, the rod lens array is constituted of plastic rod lenses. The plastic lens is composed of a resin having a linear expansion coefficient of about $1\times10^{-5}$/cm, such as those employed commercially for reading scanner produced by Mitsubishi Rayon Co., Ltd.

As described above, air introduction holes are formed on the both ends of the LED print head, and cooling air is introduced at a positive pressure through the holes into the cavity between the lenses and the LED element arrays by means of a fan or a pressure-feeding pump.

With the light emission by the LED element array, Joule heat is generated, the heat radiation by the infrared ray, and heat conduction and convention flow of the gas above the element surface cause rise of the temperature of lower part of the lens array, the lens face opposing the element, and the inside of the lens. The above-mentioned air introduction expels the warmed gas to prevent the temperature rise of the elements and lenses. The expelled air is discharged through the many discharging holes provided on the side.

The surfaces of the elements and lenses can be protected from dusts like a suspending toner by separating the air introduction holes from the environment and introducing the air through a tube or the like. A dust-protective filer is effectively attached at the air introduction holes.

The first, second, and third holes through the lens support 6400 may be formed during shaping the metal like aluminum, or after the lens support shaping.

An image-forming apparatus can be constructed by placing a photosensitive drum and the aforementioned LED head in opposition.

INDUSTRIAL APPLICABILITY

The light-emitting unit of the present invention is useful industrially as a scanner head or a printer head.

The present invention is not limited to the above embodiments and various changes and modifications can be made within the spirit and scope of the present invention.

This application claims the benefit of Japanese Patent Application No. 2008-118810, filed Apr. 30, 2008, which is hereby incorporated by reference in its entirety.

The invention claimed is:

1. A light-emitting unit having an arrayed light source, comprising:

a substrate;

an arrayed light source containing a plurality of light sources arranged in a first direction on the substrate;

a lens array for focusing the light emitted from the arrayed light source; and a lens support having a cavity formed between the arrayed light source and the lens array;

the lens support having a first hole for introducing a fluid in the first direction into the cavity, and a second hole for discharging the introduced fluid in a second direction crossing the first direction.

2. The light-emitting unit according to claim 1, wherein the lens support has a plurality of the second holes arranged in the first direction.

3. The light-emitting unit according to claim 1, wherein a pressure-rising unit is provided in the first hole for rising the pressure of the fluid in the cavity.

4. The light-emitting unit according to claim 1, wherein the first hole and the second hole are closed by a member for closing the first hole and the second hole.

5. The light-emitting unit according to claim 1, wherein the fluid is a gas.

6. The light-emitting unit according to claim 1, wherein third holes are formed through the side face of the lens support in opposition to the second holes.

7. The light-emitting unit according to claim 1, wherein the lens array is a rod lens array.

8. The light-emitting unit according to claim 1, wherein the lens array is formed from a plastic material, the substrate is formed from silicon.

9. An image-forming apparatus comprising:

the light-emitting unit set forth in claim 1, and a photosensitive drum for forming a latent image on irradiation with light from the light-emitting unit.

10. The light-emitting unit according to claim 1, wherein the light source includes a plurality of light emitting elements.

11. The light-emitting unit according to claim 10, wherein the light-emitting element is an LED.

12. The light-emitting unit according to claim 10, wherein the light-emitting element is a light element having a semiconductor multi-layered mirror.

13. The light-emitting unit according to claim 10, wherein the light-emitting elements are placed on a silicon member.

* * * * *